US010028541B2

(12) United States Patent
Johnson

(10) Patent No.: US 10,028,541 B2
(45) Date of Patent: Jul. 24, 2018

(54) GARMENT WITH FRONT AND BACK ZIPPER

(71) Applicant: S Jermikko Johnson, Chicago, IL (US)

(72) Inventor: S Jermikko Johnson, Chicago, IL (US)

( * ) Notice: Subject to any disclaimer, the term of this patent is extended or adjusted under 35 U.S.C. 154(b) by 202 days.

(21) Appl. No.: 15/134,504

(22) Filed: Apr. 21, 2016

(65) Prior Publication Data

US 2017/0164665 A1 Jun. 15, 2017

Related U.S. Application Data

(60) Provisional application No. 62/386,763, filed on Dec. 10, 2015.

(51) Int. Cl.

| | |
|---|---|
| ***A41D 3/08*** | (2006.01) |
| ***A41D 15/00*** | (2006.01) |
| ***A41D 27/20*** | (2006.01) |

(52) U.S. Cl.

CPC ..... *A41D 15/00* (2013.01); *A41D 27/205* (2013.01); *A41D 2200/20* (2013.01); *A41D 2300/30* (2013.01)

(58) Field of Classification Search

CPC ..... A41D 2200/20; A41D 3/06; A42B 1/046; A41F 1/00

See application file for complete search history.

(56) References Cited

U.S. PATENT DOCUMENTS

| | | | | |
|---|---|---|---|---|
| 2,129,464 | A * | 9/1938 | Cunningham | C01B 11/10 23/296 |
| 3,147,490 | A * | 9/1964 | Allen | A41D 3/00 2/84 |
| 8,272,072 | B1 * | 9/2012 | Fowler | A41D 15/00 2/263 |
| 9,723,882 | B2 * | 8/2017 | Reuben | A41D 15/04 |
| 2009/0055991 | A1 * | 3/2009 | Johnson | A41D 1/04 2/84 |
| 2013/0042383 | A1 * | 2/2013 | Ryan | A41D 15/00 2/84 |
| 2016/0309812 | A1 * | 10/2016 | Scheid | A41D 3/00 |

FOREIGN PATENT DOCUMENTS

| | | |
|---|---|---|
| CN | 202919058 A4 | 5/2013 |
| CN | 103156310 A4 | 6/2013 |

* cited by examiner

*Primary Examiner* — Tejash Patel

(74) *Attorney, Agent, or Firm* — Vitale, Vickrey, Niro & Gasey

(57) ABSTRACT

This disclosure relates to a garment having zippers for separating the garment into two halves. The garment has a zipper on the front and a zipper on the back. The halves can be mixed and matched according to preference for color, surface ornamentation, or material. Each half has an inside pocket that can be used for storing an additional garment half. The garment may optionally include a hood. In embodiments where the garment has a hood, the back zipper may unzip as the slider is moved in the downward direction, thereby allowing the user to separate the hood and fold the hood into a collar.

9 Claims, 5 Drawing Sheets

GARMENT WITH FRONT AND BACK ZIPPER

The present application claims priority to provisional application No. 62/386,763, filed on Dec. 10, 2015.

FIELD OF THE INVENTION

The present invention applies to zip-up garments, which may also include a hood. The present disclosure may include a hood and two zippers on the garment, which allow the garment to be separated into two halves. Additionally, various fasteners are disclosed which may be used instead of zippers.

BACKGROUND OF THE INVENTION

Prior art garments use zippers for opening and closing the garment. The prior art fails to disclose garment halves that can be mixed and matched according to preference for color, surface ornamentation, or material. Prior art garment halves are not designed to be mixed and matched. Moreover, prior art garments fail to disclose a garment having a hood that can be unzipped and converted into a shawl collar. Prior art garments also lack a pouch inside the garment for storing an additional garment half.

What is needed is a garment design that allows the wearer to separate the garment into halves and mix and match these halves according to the wearer's preference for color, surface ornamentation, or material. Moreover, this garment design may further include a hood which can be folded and converted into a collar for certain situations where wearing a garment is inappropriate or disadvantageous.

SUMMARY OF THE INVENTION

This disclosure relates to a garment, with a zipper in the front and a zipper in the back of the garment. A hood that can be unzipped to create a shawl collar is also disclosed. The zippers allow the user to separate the garment into two halves, which can be mixed and matched. The insertion pin and pin box for each of the zippers are located at the bottom of the garment. The direction of the zipper in the back of the garment allows the wearer to fold the hood into a collar. The pouch attached to the inside of each of the garment halves allows the wearer to store an additional garment half.

Figure 1:
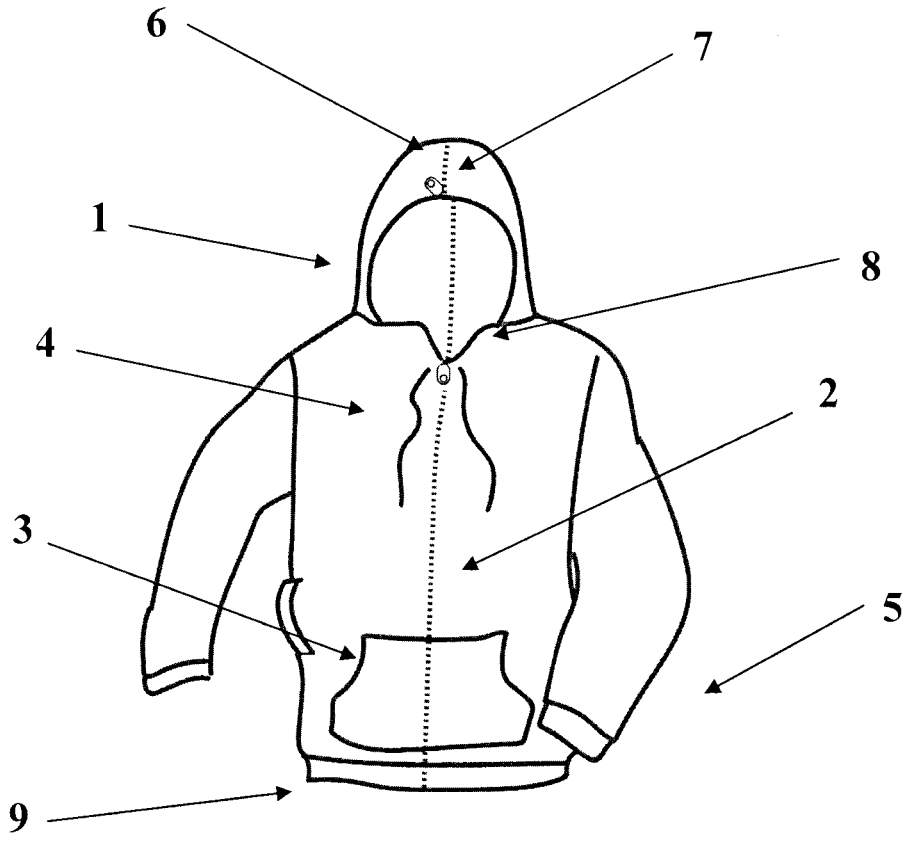
FIG. 1 shows the front of a garment with the front and back zippers zipped up fully.

Several drawings and illustrations have been presented to aid in the understanding of the present invention. The scope of the present invention is not limited to the figures.

DETAILED DESCRIPTION OF EMBODIMENTS OF THE INVENTION

Referring now to the drawings, in which like numbers refer to like elements throughout the several views, FIGS. 1-5 show embodiments of the garment of the present disclosure. For example, in FIG. 1 the front of a hooded garment is seen. One embodiment of a hooded garment is a hoodie sweatshirt which normally has a hood 1, a zipper on the front of the garment 2, a muff 3, a drawstring to adjust the hood opening 4, and long sleeves 5. The embodiment of FIG. 1 also includes a zipper extending from the top of the hood 1 along the back of the garment 6 with a top stop 7 at the top of the hood 1. The zipper on the front 2 unzips from the top of the garment, at the collar 8, to the bottom of the garment, at the waistline 9.

A person of ordinary skill in the art would understand that various types of fasteners may be used in place of, or in combination with, the disclosed zippers. For example, instead of a zipper, the garment may have a different fastener or mechanism for separating the garment in half from the top of the hood to the bottom of the garment such as buttons, Velcro, or snaps. An alternative fastener or mechanism must also allow the wearer to fold and convert the hood into a collar.

Figure 2:
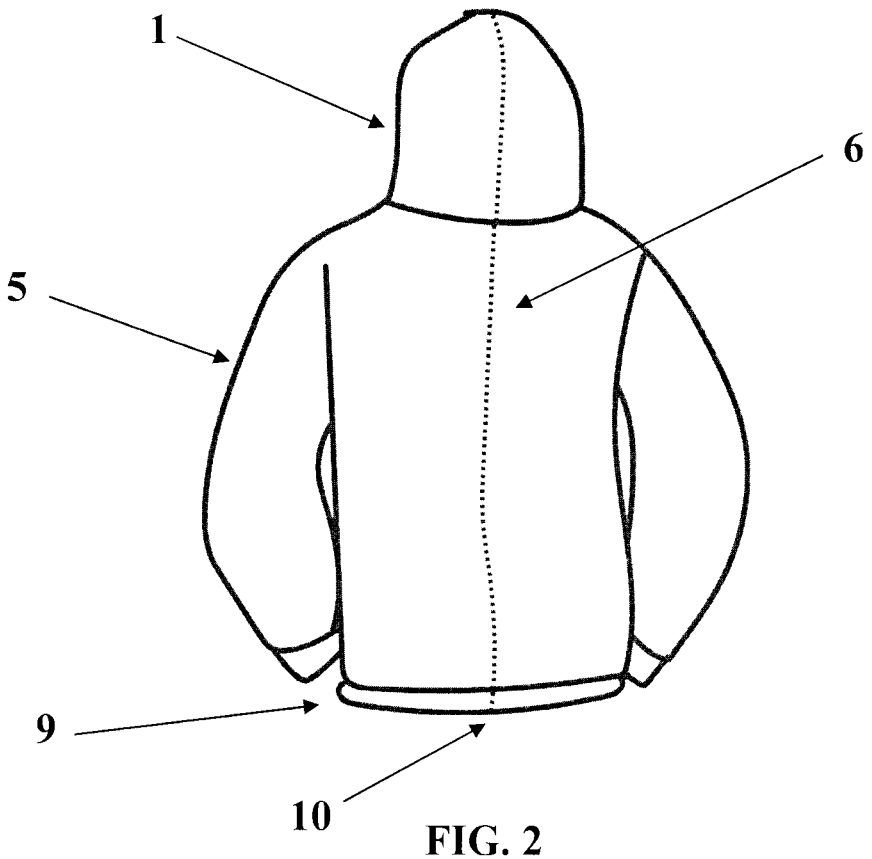
FIG. 2 shows the back of a garment with the front and back zippers zipped up fully.
Figure 3:
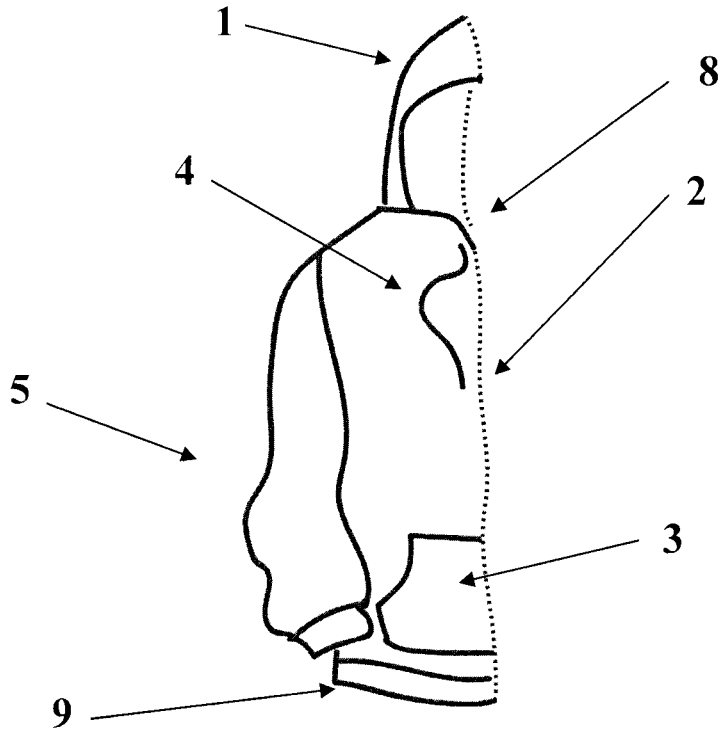
FIG. 3 shows the front of one half of a garment. The front and back zippers on the garment are unzipped and the other half of the garment is detached.

FIG. 2 shows the back of the present invention. The pin box 10 on the back zipper is visible at the bottom of the garment. The back zipper unzips from the top of the hood 1 down to the waistline 9. The two zippers allow the garment to be separated in two halves, and also allow one half to be interchanged with a third half. Half of a hooded garment is shown in FIG. 3. Various halves are interchangeable with each other. One half can be attached to a variety of different halves of the same size and opposite orientation that differ based on color, material, or surface ornamentation.

Figure 4:
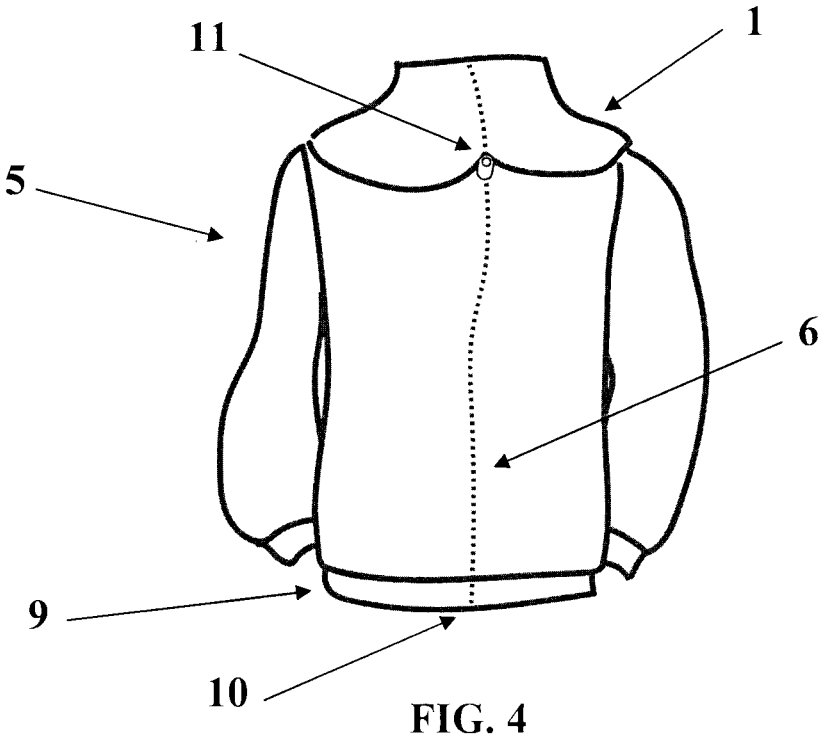
FIG. 4 shows the back of a garment with the back zipper partially zipped down. The hood is partially separated at the zipper, and the hood is folded down to form a collar.

An additional feature of the present disclosure is that the garment may have a hood that is foldable into a shawl collar. FIG. 4 shows the back of a hooded garment with a back zipper 6 in the partially unzipped configuration. The hood may collapse into a shawl collar configuration by zipping the back slider 11 in the downward direction from the top of the hood 1. In other words, zipping the back zipper away from the pin box 10 causes the hood to divide in half and allows the hood to convert into a shawl collar.

Figure 5:
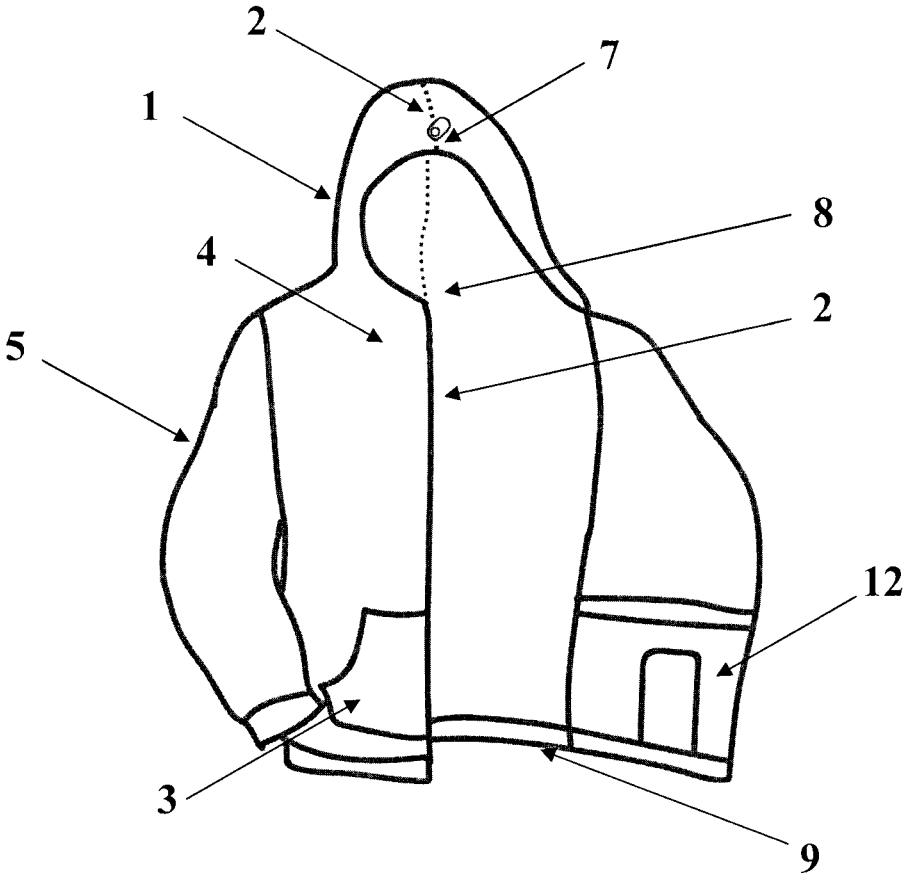
FIG. 5 shows the front of a garment with the front zipper fully unzipped and the back zipper fully zipped. The front of the garment is pulled open and the inside of the garment is visible. The inside pocket on the inside of the front of the garment is visible.

FIG. 5 shows the front view of an embodiment of the present disclosure in which the front zipper 2 is fully unzipped and the back zipper 6 fully zipped. The front of the garment is shown to be open and the inside of the garment is visible. An inside pocket 12 on the inside of the front of the garment is shown. The inside pocket 12 allows the wearer to store a garment half in addition to the halves which are joined by zipper to form the garment. The inside pocket 12 can also be used for general storage, such as for mobile devices and other valuables. The inside pocket 12 can be made from the same material as the garment half or from another material altogether, such as something lighter and more compact.

In addition to or instead of the inside pocket 12, the garment may have some other mechanism either on the inside or outside of the garment for storing a garment half.

Several descriptions and illustrations have been provided to aid in the understanding of the present invention. It will be clear to one skilled in the art that many modifications and embodiments are possible. All such changes and variations are also within the scope of the present invention. It is intended that the scope of the present invention be defined by the claims.

What is claimed is:

1. A hooded garment comprising:

a first garment half, said first garment half having half of a hood portion, half of the garment's front torso, and half of the garment's back torso;

a second garment half, said second garment half having half of a hood portion, half of the garment's front torso, and half of the garment's back torso;

a fastener attached to the first garment half's front and to the second garment half's front, said fastener positioned on the garment to allow the wearer to unfasten the first and second torso portions from the garment's collar to the garment's waistline;

a fastener attached to the first garment half's back and the second garment half's back, said fastener positioned on the garment to allow the wearer to unfasten the first and second torso portions from the top of the garment's hood to the garment's waistline;

wherein both hood portions are configured to fold into a collar;

and wherein at least one garment half further comprises an inside pocket configured to store at least one additional garment half that is not in use.

2. The hooded garment as defined in claim 1, wherein each said torso portion includes an arm portion integrally attached to said torso portion.

3. The hooded garment as defined in claim 1, wherein at least one fastener is a zipper.

4. The hooded garment as defined in claim 1, wherein at least one fastener is a button.

5. The hooded garment as defined in claim 1, wherein at least one fastener is a snap.

6. The hooded garment as defined in claim 1, wherein a third garment half is stored in the inside pocket.

7. A hooded garment comprising:

a front side and a back side;

an inside pocket at the front side's inside;

a hood which folds into a collar; and a zipper, the zipper having a top stop at the hood's front and a stop tab at the back side's bottom, the zipper extending down the back side;

a second zipper extending down the hooded garment's front side;

wherein the hooded garment has a first garment half and a second garment half, each having a different color for interchangeability; and wherein the inside pocket is configured to receive an additional garment half.

8. The hooded garment as defined in claim 7, wherein the zipper and the second zipper are configured to allow the hooded garment to be zipped into two halves.

9. The hooded garment as defined in claim 8, wherein the hood portion of the two garment halves form a shawl when partially unzipped.

* * * * *